United States Patent [19]

Cohen

[11] Patent Number: 4,804,339

[45] Date of Patent: Feb. 14, 1989

[54] CONNECTOR WITH COMPRESSIBLE INSULATIVE BODY

[75] Inventor: Thomas S. Cohen, Wormleysburg, Pa.

[73] Assignee: AMP Incorporated, Harrisburg, Pa.

[21] Appl. No.: 101,046

[22] Filed: Sep. 25, 1987

[51] Int. Cl.[4] ..... H01R 13/40

[52] U.S. Cl. ..... 439/588; 439/80; 439/82

[58] Field of Search ..... 439/588, 589, 598, 675, 439/668, 669, 76, 80–82, 78

[56] References Cited

U.S. PATENT DOCUMENTS

| | | | |
|---|---|---|---|
| 3,500,297 | 3/1970 | Bac | 339/217 |
| 3,697,926 | 10/1972 | Krafthefer | 339/17 L |
| 4,605,269 | 8/1986 | Cohen et al. | 439/63 |
| 4,609,242 | 9/1986 | Kemppainen | 339/17 LC |
| 4,659,156 | 4/1987 | Johnescu et al. | 439/63 |
| 4,666,231 | 5/1987 | Sheesley et al. | 339/177 R |
| 4,702,707 | 10/1987 | Hillbish | 429/80 |
| 4,709,973 | 12/1987 | Waters et al. | 439/82 |

FOREIGN PATENT DOCUMENTS 921284 3/1963 United Kingdom .

OTHER PUBLICATIONS

Drawings from Appl. Ser. No. 006,522, filed 1/23/87.

*Primary Examiner*—Gil Weidenfeld
*Assistant Examiner*—P. Austin Bradley

[57] ABSTRACT

A connector (1) comprises contacts (5,6, 5,6) slidably received within passages (40,40) and cavities (44,44, 49,49) within an insulative body (3), the assembly of which is further received within a shell (2). Upon assembly of the insulative body (3) and shell (2), the insulative body (3) is compressed about the contacts securing the insulative body (3) and contacts within the shell (2).

17 Claims, 10 Drawing Sheets

CONNECTOR WITH COMPRESSIBLE INSULATIVE BODY

FIELD OF THE INVENTION

The invention relates to an electrical connector assembly and, more particularly, to an electrical connector assembly with electrical contacts retained within a passage of an insulative body.

BACKGROUND OF THE INVENTION

An assembly of an insulative body and electrical contacts can be accomplished by an injection moulding apparatus. The apparatus includes moulding dies that close against each other and enclose a cavity that is partially in both dies. An internal shape of the cavity forms a fluent insulative substance to a desired external shape of the body. The apparatus holds the contacts stationary, as the fluent substance is injected into the cavity, and as the substance flows to surround the contacts, and as the substance become solidified to form the insulative body. The stationary electrical contacts become imbedded in the solidified substance. If cavities are desired in the solidified substance, devices known as core pins project into the cavity as the fluent substance is injected and as the substance is solidified while surrounding the core pins. Following solidification of the substance, the core pins must be withdrawn, the moulding dies must be opened by being separated from each other, and the assembly of the insulative body and the contacts must be ejected from the apparatus. A disadvantage of injection moulding is attributed to; difficulty in assembly of the contacts in the moulding apparatus, difficulty in maintaining the contacts stationary, obstruction to flow the fluent substance because the contacts are obstructions in the moulding cavity, and difficulty in avoiding damage to the contacts upon withdrawing the contacts from the moulding apparatus.

The cost of moulding is reduced if the insulative body is moulded with empty cavities that later receive corresponding contacts. For example, a known electrical connector assembly is disclosed in U.S. Pat. No. 4,666,231 as having a conductive shell enclosing an insulative body, and further having electrical contacts assembled within corresponding cavities of the insulative body. The body and shell fit within each other with a sliding fit. An insulative pin is located in a channel of the body and an aperture in the shell to resist sliding movement of the body and shell. The contacts have thin elongated portions that fit within corresponding cavities with a sliding fit. Portions of the contacts that project from the cavities are bent transversely of their lengths to register within recesses that intersect the cavities, thereby to resist sliding movement of the contacts. A disadvantage associated with assembly of the contacts is; sliding movement of the assembled parts must be resisted by a pin or by bending the contacts after insertion of the contacts.

SUMMARY OF THE INVENTION

An advantage of the invention resides in assembly of electrical contacts with a sliding fit within corresponding cavities of an insulative body and assembly of the body in a rigid shell to retain the contacts in the cavities and to retain the body within the shell without reliance upon a pin or reliance upon bending the contacts after insertion in the cavities.

Another advantage of the invention resides in retention of a compressible insulative body with a wedge fit in a rigid shell and with a compression fit between the shell and lateral edges along thickness planes of corresponding electrical contacts that have been assembled with a sliding fit within cavities of the body.

According to another advantage of the invention, electrical contacts are assembled with a sliding fit within corresponding cavities of a compressible insulative body, the body and a rigid shell are assembled with a compression wedge fit, the body is compressed between the shell and edges of the contacts to resist movement of the body with respect to the shell, and the cavities are closed against the edges of the contacts to resist movement of the edges with respect to the body.

A further advantage of the invention resides in electrical contacts assembled with a sliding fit within corresponding cavities of a compressible insulative body, wherein the body is assembled with a compression wedge fit within a rigid shell, the body is compressed between the shell and edges of the contacts to resist movement of the body, the cavities are closed against the edges of the contacts to resist movement of the edges with respect to the body, and contact portions of the contacts extend into enlarged passages in the body that allow motion of a contact portion of a corresponding electrical contact toward and away from another contact portion of another corresponding contact.

Another advantage of the invention resides in the assembly as described in the adjacent previous paragraph of text and further wherein, a contact portion of a corresponding electrical contact extends outwardly from a base portion of the contact and is curved back along itself in a direction toward the base portion and into engagement with another contact portion of another corresponding electrical contact, and an interior wall of the insulative body biases the curved back contact portion in compression against said another contact portion.

Another advantage of the invention resides in ease of assembly of the parts and retention of the parts of an electrical connector assembly in assembled configuration without a requirement for an operation to be performed on either the insulative body or the contacts subsequent to insertion of the contacts in the body and insertion of the body in the shell. Other aspects and advantages of the invention are apparent by way of example from the following detailed description taken in conjunction with accompanying drawings.

DETAILED DESCRIPTION

Figure 1:
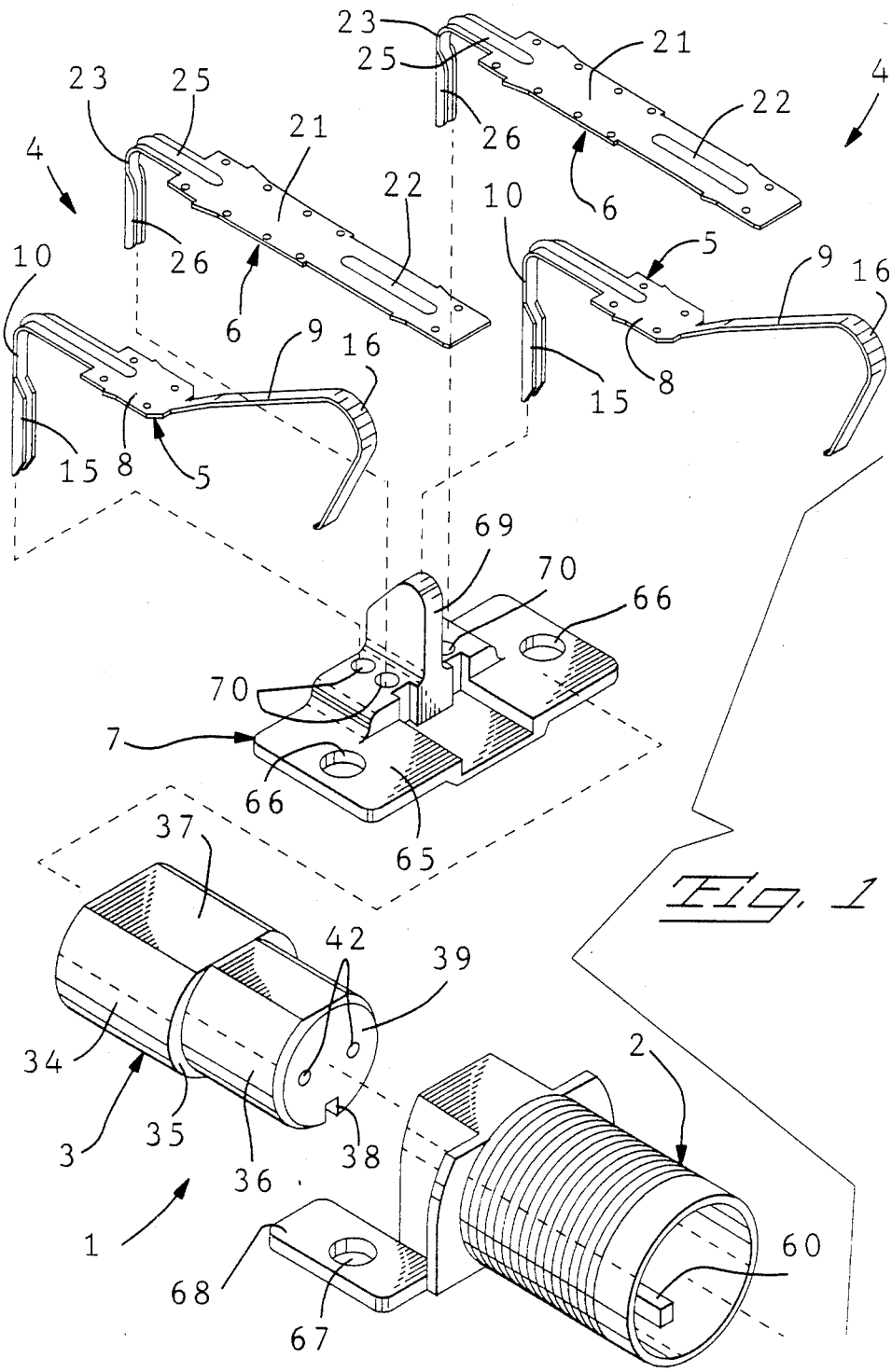
FIG. 1 is a perspective view of a connector assembly with parts shown exploded.

With reference to FIGS. 1–5 a connector assembly is illustrated by way of example, and includes, a rigid external shell 2 that is conductive, an insulative body 3 assembled in the shell 2, a first pair 4 of conductive electrical contacts 5,6 and a second pair of conductive electrical contacts 5,6 assembled in the body 3. An insulative tray 7 supports the shell 2 and the contacts 5,6, 5,6 and becomes a part of the connector assembly 1 when mounted thereto.

Figure 1A:
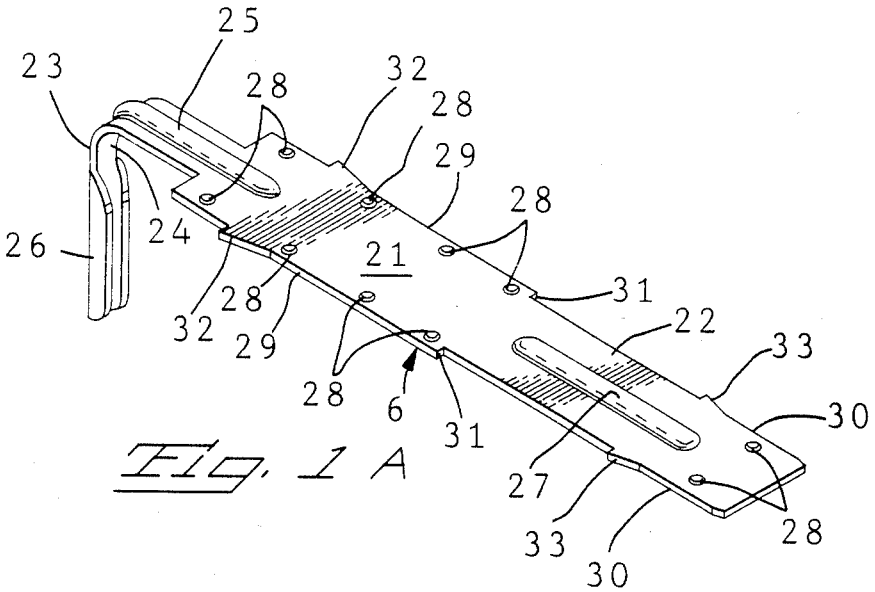
FIG. 1A is an enlarged perspective view of a contact of the connector assembly.
Figure 1B:
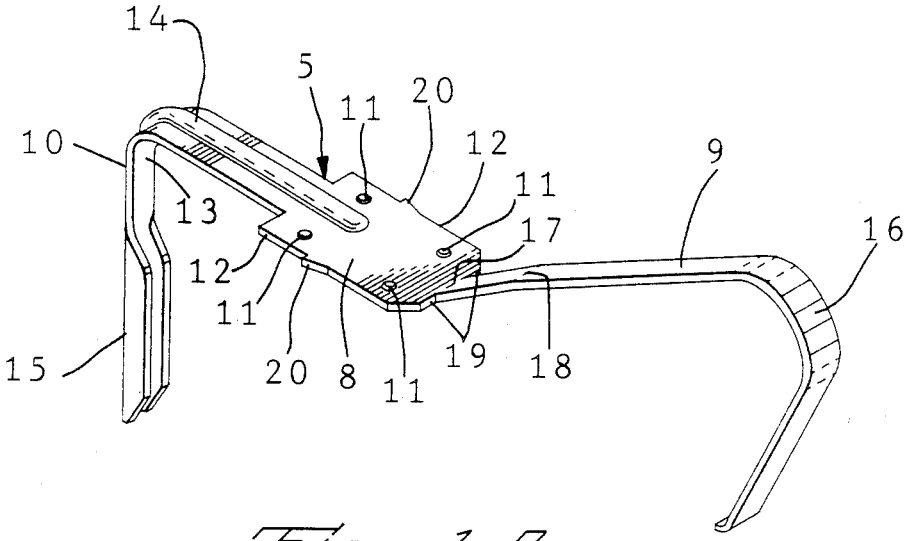
FIG. 1B is an enlarged perspective view of another contact of the connector assembly.

As shown in FIG. 1B, the contact 5,5 of each corresponding pair 4,4 of contacts 5,5, 6,6 is an elongated and unitary strip of metal, and includes a planar base 8, an elongated contact portion 9 and an elongated electrical terminal 10. Raised bulges 11,11 are formed in the thickness plane of the base 8. The bulges 11,11 are axially aligned in series along the lateral side edges 12,12 of the base.

The terminal 10 extends from the base 8 rearwardly, meaning in a direction toward a rear of the contact 5. The terminal 10 is formed with a bend 13 to extend at an angle to the plane of the base 8. The terminal 10 also may extend without the bend 13 if desired. A means comprising a raised rib 14 extends along the length of the terminal 10 and extends partially along the base 8 for resisting undesired bending of the terminal 10 and base 8. The rib 14 is formed by a bulge in the thickness plane of the terminal 10 and the base 8. An enlarged circumference section 15 of the terminal 10 is provided by a channel cross section of the terminal 10.

The contact portion 9 extends from the base 8 forwardly, meaning in a direction toward a front of the contact 5, and outwardly of the plane of the base 8, and is curved back on itself, at a curved back portion 16 and extends rearwardly and toward the other contact 6 of the corresponding pair 4 of contacts 5,6. The contact portion 9 is provided with a first bend 17, adjacent to the base 8 and a second bend 18 spaced along the contact from the first bend 17 and spaced from the curfed back portion 16. The contact portion 9 is sloped from the first bend 17 at a first oblique angle with respect to the base 8. The contact portion 9 is sloped from the second bend 18 at a second oblique angle of less slope. The contact portion 9 is an elongated and resilient leaf spring.

The side edges 12,12 are in the plane of thickness of the base 8 and extend axially along the base 8. A width of the base 8 from side edge 12 to side edge 12 is larger than the width of the terminal 10 or with width of the contact portion 9. Forwardly facing shoulders 19,19 are on a front end of the base 8. Projecting barbs 20,20 extend laterally from the corresponding side edges 12,12 of the base 8 and are in the thickness plane of the base 8.

As shown in FIG. 1A, the other contact 6 of each corresponding pair 4,4 of contacts 5,6, 5,6 is an elongated and unitary strip of metal and includes a planar base 21, a contact portion 22 and an electrical terminal 23. The terminal 23 extends from the base 21 rearwardly. The terminal 23 is formed with a bend 24 to extend at an angle to the plane of the base 21. The terminal 23 also may extend without the bend if desired. The tray 7 is not assembled if the terminals 23,23 and 10,10 extend without the corresponding bends. A means in the form of a raised rib 25 extends along the length of the terminal 23 and extends partially along the base 21 for resisting undesired bending of the terminal 23 and the base 21. The rib 25 is formed by a bulge in the thickness plane of the terminal 23 and the base 21. An enlarged circumference 26 of the terminal 23 is provided by a channel shaped cross section of the terminal 23.

The contact portion 22 extends from the base 21 forwardly. A means in the form of a raised rib 27 extends along the length of the contact portion 22 for resisting undesired bending of the contact portion 22. The rib 27 is formed by a bulge in the thickness plane of the contact portion 22. Raised bulges 28,28 are formed in the thickness plane of the base 21, and are axially aligned in series along the lateral edges 29,29 of the base. Additional raised bulges 28,28 are formed in the thickness plane of the contact portion 22. The bulges 28,28 are along the lateral side edges 30,30 of the contact portion 21.

Side edges 29,29 in the plane of thickness of the base 21 extend axially along the base 21. A width of the base 21 from side edge 29 to side edge 29 is larger than the width of the terminal 23 and the width of the contact portion 22. Forwardly facing shoulders 31,31 are on a front end of the base. Projecting barbs 32,32 extend laterally from the corresponding side edges 29,29 of the base 21 and are in the thickness plane of the base 21. Additional projecting barbs 33,33 extend laterally from the side edges 30,30 of the contact portion 22 and are in the thickness plane of the contact portion 22.

Figure 2:
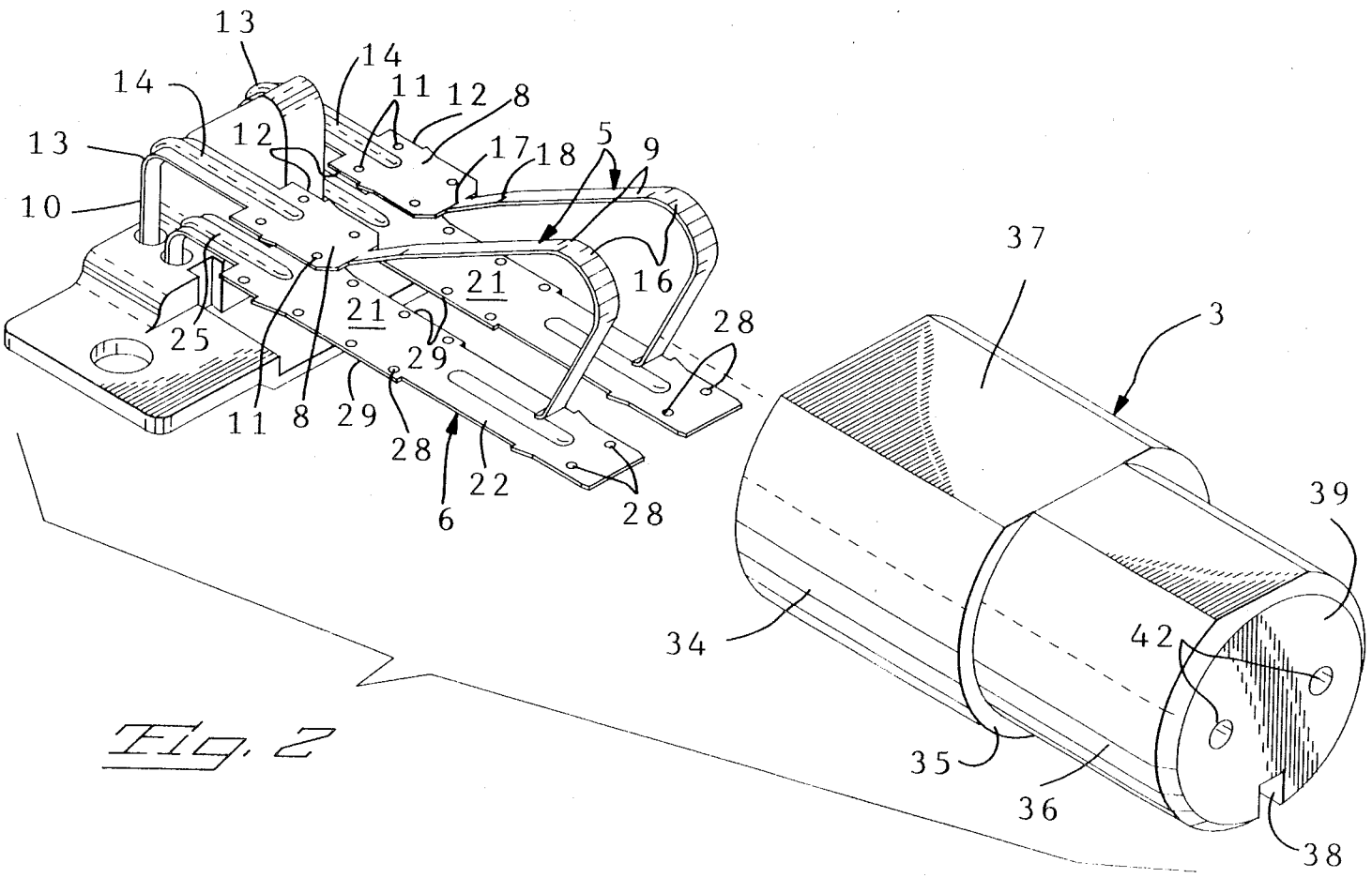
FIG. 2 is an enlarged perspective view of a portion of the connector assembly shown in FIG. 1.

As shown in the FIG. 2, the body 3 is fabricated by moulding a resiliently compressible and insulative material. The body 3 has a stepped cylindrical exterior defining an enlarged diameter rearward end portion 34, a forwardly facing external shoulder 35 at a front end of the rearward end portion 34 and a maller diameter forward end portion 36. An exterior flat surface 37 extends axially and intersects the cylindrical exterior. An axially extending keyway 38 in the exterior of the body 3 is laterally across from the flat surface 37. The keyway 38 communicates with a front end 39 of the body 3.

As shown in FIGS. 3–7 a pair of passages 40,40 communicate with rear end 41 of the body 3 and extend axially of the body 3 toward the front end 39 of the body 3. One of a pair of slender and axially extending openings 42,42 in the front end 39 of the body 3 communicates with a corresponding passage 40,40. Each opening 42 extends along a ledge 43 that is laterally adjacent the opening 42. The ledge 43 is part of the front end 39 of the body 3 and extends axially into the corresponding passage 40.

Figure 6:
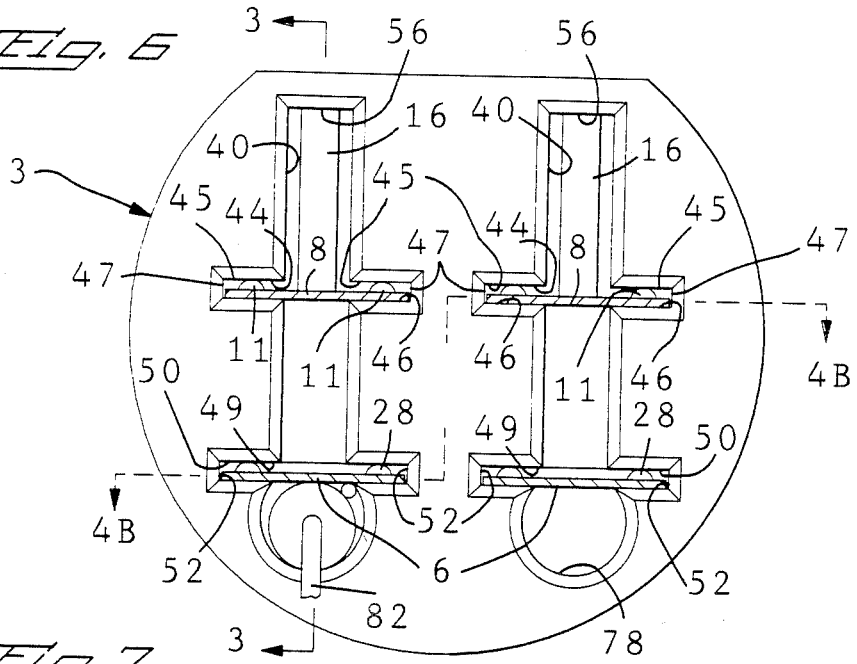
FIG. 6 is an enlarged section view taken along the line 6—6 of FIG. 4.

As shown in FIGS. 3, 4, 6, 7, 8, and 9, each passage 40,40 intersects a corresponding first cavity 44,44 that communicates with the rear end 41 of the body. Each cavity 44 has a height extending between an axially extending top wall 45 and an axially extending planar bottom wall 46 opposite the top wall 45. Each cavity 44 has spaced apart opposite sides 47,47 and has a width extending between the opposite sides 47,47. As shown in FIG. 4A, a relatively wide, base receiving portion 48 of the cavity 47 extends axially forwardly of the rearward end portion 34 of the body 3. The width of the cavity 47 along the base receiving portion 48 is greater than the wdith of the base 8 of a corresponding contact 5, and is less than a combined width determined by the widths of the barbs 20,20 added to the width of the base 8. As shown in FIG. 6, a height of the cavity 44 along the base receiving portion 48 is greater than the thickness of the base 8, and is less than a combined height determined by the height of each individual bulge 11,11 added to the thickness of the base 8.

Each contact 5 is assembled with a sliding fit into a corresponding cavity 44. During sliding fit assembly, the bulges 11,11 engage the top wall 45 of the cavity 44 and urge the base 8 against the bottom wall 46 of the cavity 44, for supporting the contact 5 and for guiding the contact 5 into the cavity 44 and corresponding passage 40. Resistance to sliding movement is reduced, because clearances are defined between the sides 47,47 of the cavity 44 and the side edges 12,12 of the base 8 of the contact 5, and because relatively small depressions are made in the body 3 where the bulges 11,11 and barbs 20,20 compress against and resiliently deform the body 3.

Figure 3:
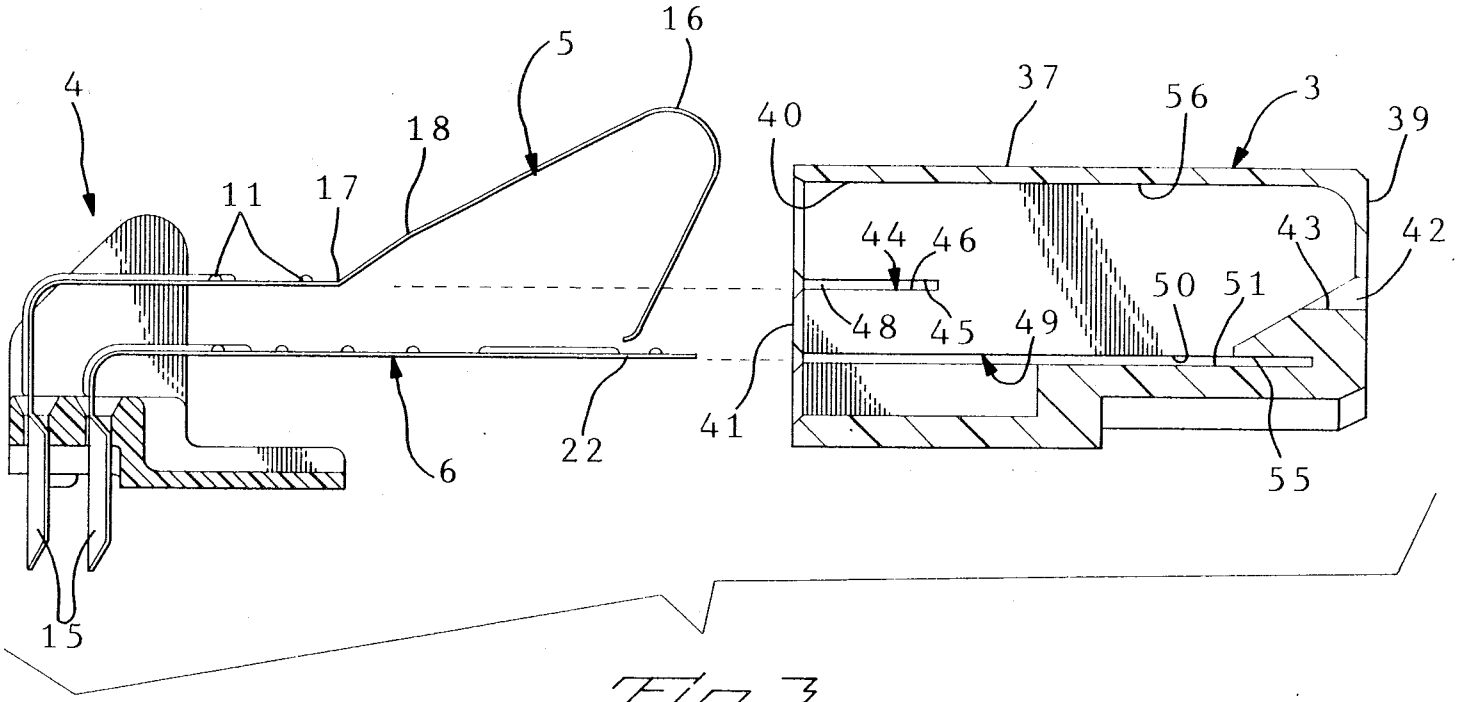
FIG. 3 is an elevation view of a part of the connector assembly shown in FIG. 1 with parts shown exploded and with parts shown in section.
Figure 4:
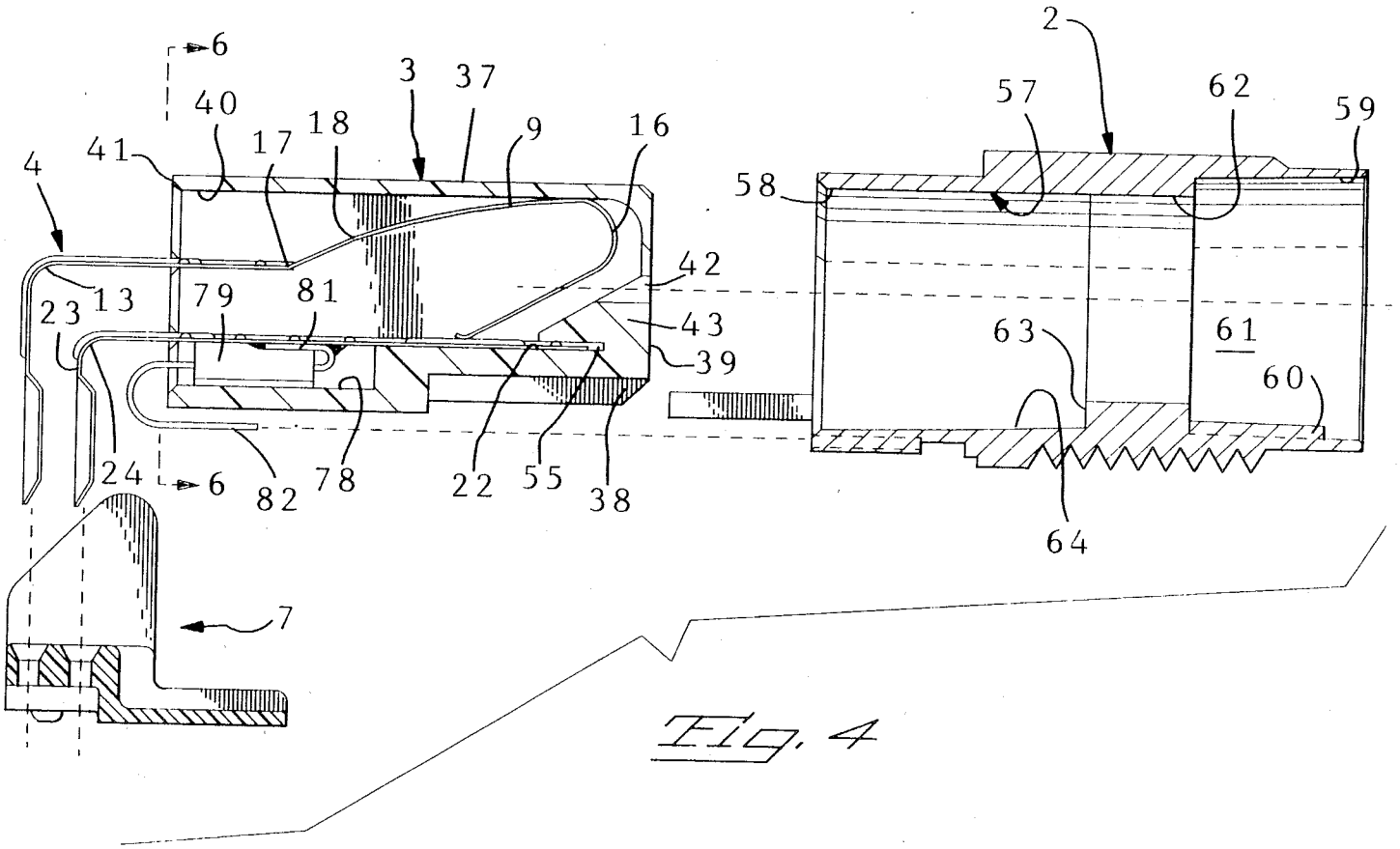
FIG. 4 is an elevation view of the connector assembly shown in FIG. 1 and with parts shown partially assembled.
Figure 4B:
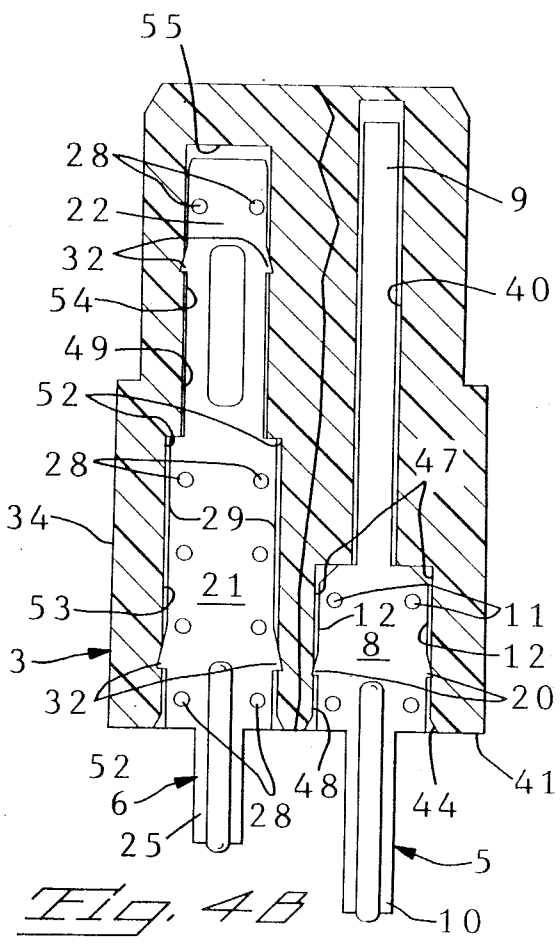
FIG. 4B is a section view taken along the line 4B—4B of FIG. 6.
Figure 4A:
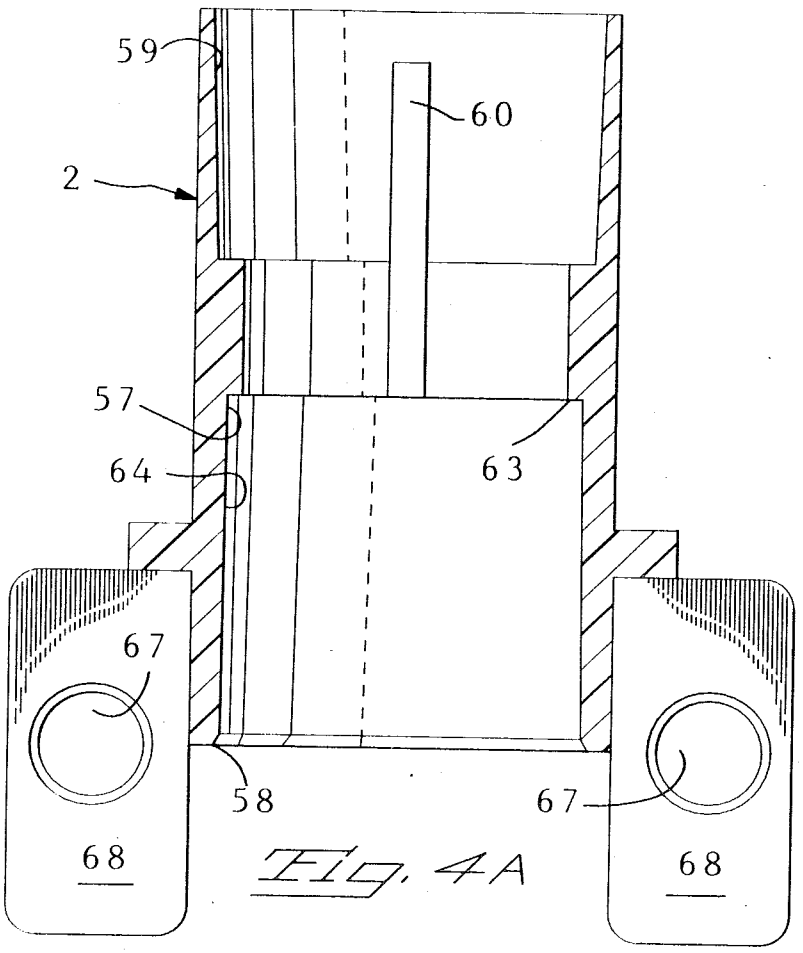
FIG. 4A is a section plan view in section of a portion of the connector shown in FIG. 1.

As shown in FIG. 3, each passage 40,40 intersects a corresponding second cavity 49,49 that is in the rear end 41 of the body 3. Each second cavity 49,49 has a height extending between an axially extending top wall 50 and an axially extending planar bottom wall 51 opposite the top wall 50. As shown in FIG. 6, each second cavity 49 has spaced apart opposite sides 52,52 and has a width extending between the opposite sides 52,52. As shown in FIG. 4B, a relatively wide, base receiving portion 53 of the cavity extends axially forwardly of the rearward end portion 34 of the body 3. The width of the cavity 49 along the base receiving portion 53 is greater than the width of the base 21 of a corresponding second contact 6, and is less than a combined width determined by the widths of the barbs 32,32 added to the width of the base 21. As shown in FIG. 6, a height of the cavity 49 along the base receiving portion 53 is greater than the thickness of the base 21, and is less than a combined height determined by the height of each individual bulge 28,28 added to the thickness of the base 21.

As shown in FIGS. 4B and 3, a contact receiving portion 54 of each second cavity 49 extends forwardly of the base receiving portion 53, and extends as an undercut 55 of the ledge 43. The width of the contact receiving portion 54 is less than the width of the base receiving portion 53. The width of the contact receiving portion 54 is greater than the width of a corresponding contact portion 22 of a contact 6, and is less than a combined width determined by the widths of the barbs 32,32 added to the width of the contact portion 22. The height of the second cavity 49 along the contact receiving portion 54 is greater than the thickness of the contact portion 22, and is less than the combined height determined by the height of each individual bulge 28,28 added to the thickness of the contact portion 22.

Each contact 6 is assembled with a sliding fit into a corresponding second cavity 49. The contact portion 22 of each contact extends along the forward end of the passage 40. During sliding fit assembly, the bulges 28,28 engage the top wall 50 of the second cavity 49 and urge the contact portion 22 and the base 21 against the bottom wall 51 of the second cavity 49, for supporting the contact 6 and for guiding the contact portion 22 into the undercut 54. Resistance to sliding movement is reduced, because clearances are defined between the sides 52,52 of the second cavity 49 and the corresponding side edges 29,29, 30,30 of the base 21 and of the contact portion 22, and because relatively small depressions are made in the body 3 where the bulges 28,28 and the barbs 32,32 compress against and resiliently deform the body 3.

Following assembly of the second contact 6, the first contact 5 is assembled into a corresponding cavity 44 and corresponding passage 40. As shown in FIGS. 3 and 4, the first contact 5 has its contact portion 9 with a height greater initially than the distance between the planar second contact 6 and a top wall 56 of the passage 40. The top wall 56 engages and resiliently deflects the contact portion 9 toward and into compressive engagement with the contact portion 22 of the second contact 6. The curved back portion 16 is resiliently provided toward the contact portion 22, and is partially bent further to a smaller radius of curvature, produces a resilient spring force against the contact portion 22 of the second contact 6. The stress resulting from deflection is distributed along the contact portion 9, due to the length of the shape of the contact portion 9. The contact portion 9 will bow arcuately along its length to distribute the internal stress along the length of the contact portion 9.

Figure 7:
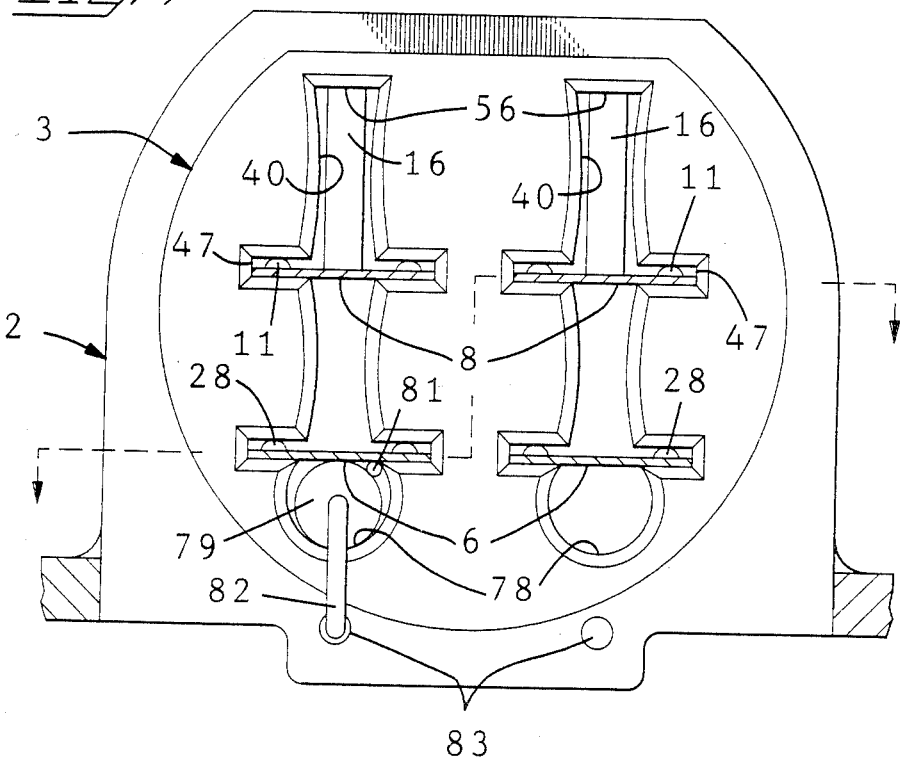
FIG. 7 is a fragmentary enlarged section view taken along the line 7—7 of FIG. 5.
Figure 9:
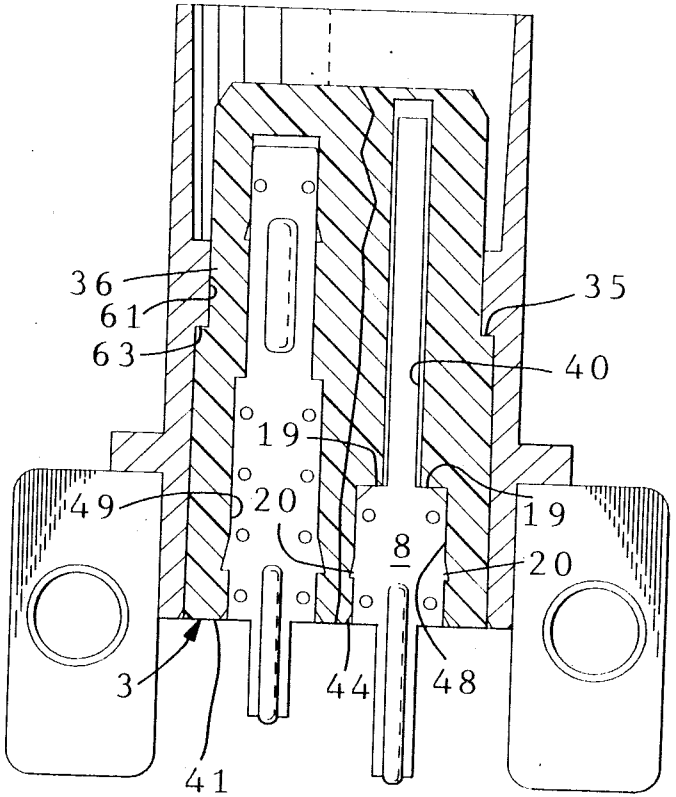
FIG. 8 and 9 are enlarged section views taken along the line 9—9 of FIG. 7, with FIG. 8 illustrating the parts partially assembled, and with FIG. 9 illustrating the parts fully assembled.
Figure 8:
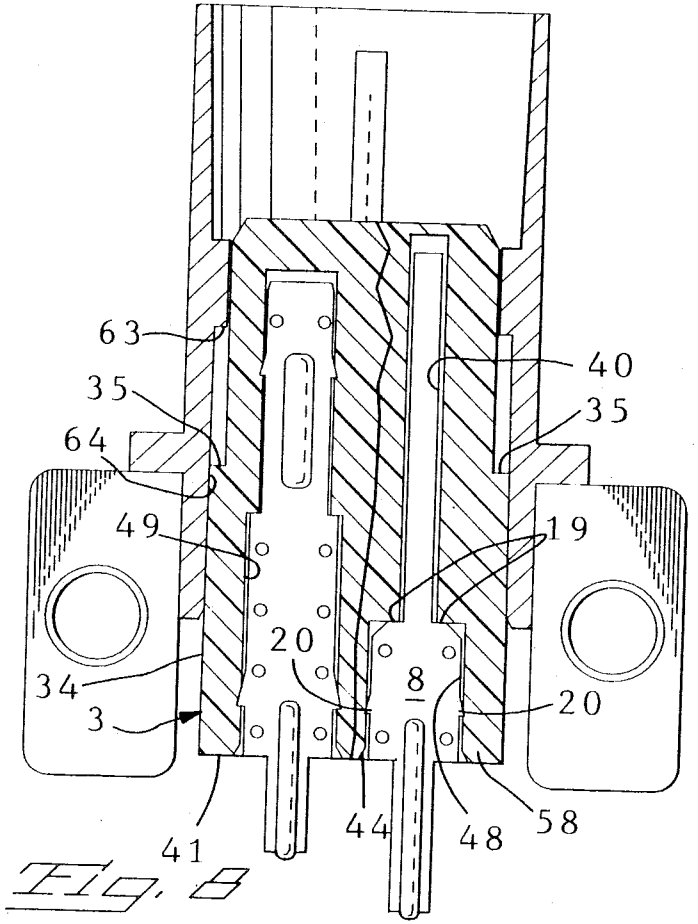
Figures 10, 10A:
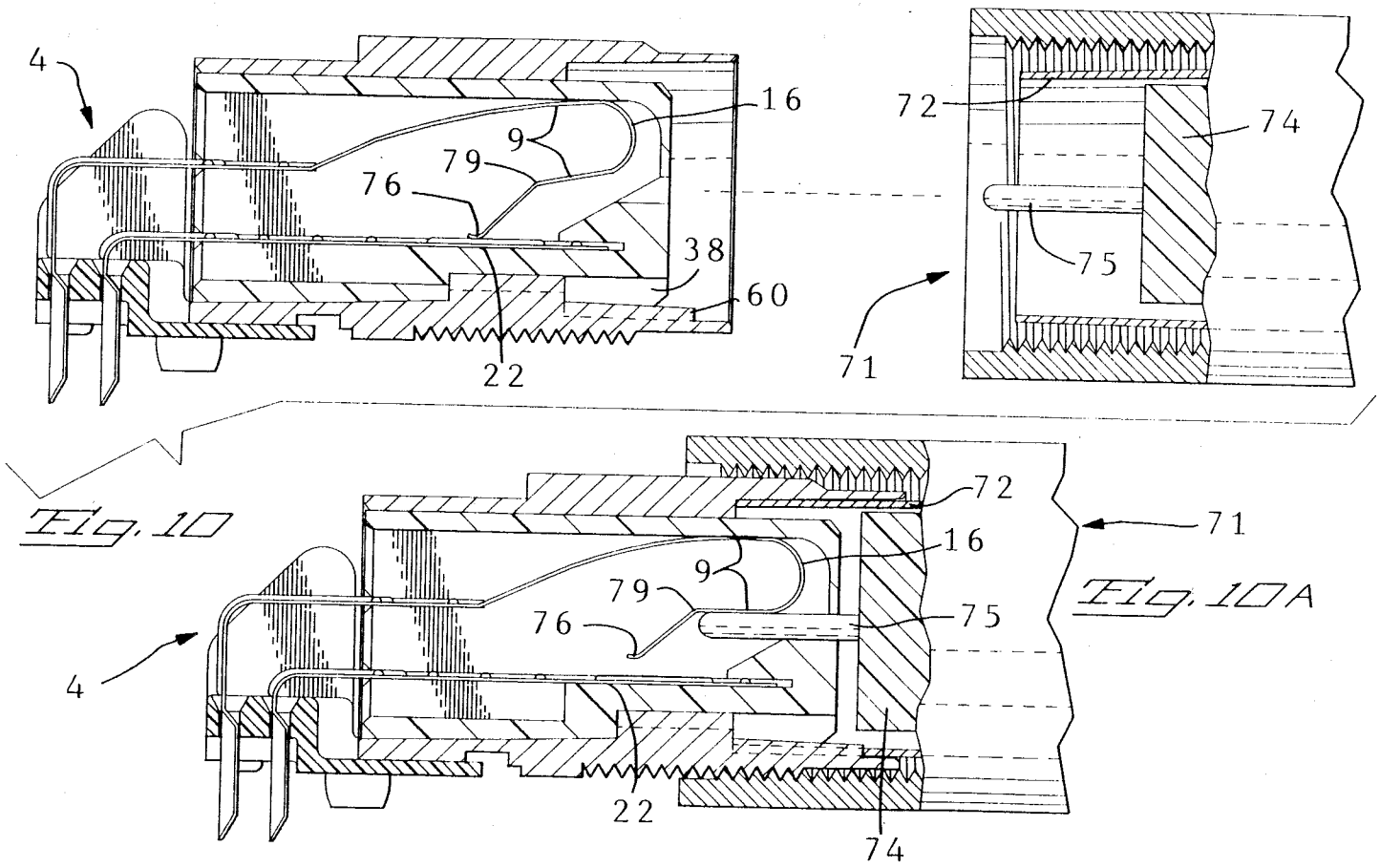
FIG. 10 is a view similar to FIG. 5 of another embodiment of an electrical connector assembly with the mating connector assembly shown in FIG. 5.
FIG. 10A is a view similar to FIG. 5A of the connector assemblies shown in FIG. 10 mated together.

The sliding fit between the body 3 and the contacts 5,5, 6,6 is an advantage for enabling ease of assembly. The sliding fit becomes a disadvantage because the contacts 5,5, 6,6 would be easily dislodged from their desired positions in the connector assembly 1. As explained below, the disadvantage is overcome by compressing the body 3 and closing the sides 47,47, 52,52 of the cavities 44,49 against corresponding side edges 12,12 29,29 of the base portions 8,21. As shown in FIGS. 4 and 4A the shell 2 has a body receiving cavity 57 extending from an open rear end 58 of the shell 3 to an open front end 59 of the shell 3. An interior projecting key 60 extends axially of and is on a front end portion 61 of the shell across the interior from an axially extending flat interior surface 62 of the shell 3. The key 60 mates with the keyway 38, and the flat surfaces 62,37 engage each other to align the compressible body 3 and the shell 2. The cavity 57 has a cross section that is stepped to provide a rearward facing interior wall 63 within the cavity 57. A rear end portion 64 of the shell 2 extends from the rear end 58 forwardly to the wall 63 and meets the front end portion 61. The cavity 57 within the rear end portion 64 has a cross section with a shape similar to that of the body 3. The cross section is of less cross sectional area than the cross section of the rear end portion 34 of the body 3. As shown in FIG. 8, as the body 3 and the contacts 5,5, 6,6 that previously were assembled to the body 3 are inserted in the rear end 58 of the shell 2, the end portion 34 of the insulative body 3 is encircled by the rear end portion 64 of the encircling shell 2. The insulating body 3 is frustoconical by being tapered externally from the rear end 41 and axially to the shoulder 35. The interior of the rear end portion 64 of the shell 2 and the rear end portion 64 of the insulative body 3 are complementary tapered. Thereby the body 3 enters the shell 2 without having to traverse through a constriction at the rear end 58 of the shell. When the body 3 is nearly fully inserted, compression, applied by the rear end portion 64 of the shell 2, is distributed over the surface of the rear end portion 34 of the insulative body 3. As shown in FIGS. 8 and 9, the base receiving portions 48,48, 53,53 of the insulative body 3 are closed against the base portions 8,8, 21,21 of the contacts 5,5, 6,6 to resist movement or withdrawal of the base portions 8,8, 21,21 from the cavities 44,44, 49,49. The sides 47,47, 52,52 of the corresponding cavities 44,49 are compressed against the side edges 12,12, 29,29 of the corresponding base portions 8,21. The base portions 8,21 resist deformation, because compressive forces are applied along the thickness planes of the respective base portions 8,21. The barbs 20,20, 32,32 in the thickness planes penetrate into the body 3 to resist withdrawal or movement of the base portions 8,21. The body 3 is compressed between the base portions 8,21 and the interior of the end portion 64 of the shell 2. Thereby, withdrawal of the body 3 from the shell 2 is resisted. The body 3 is resiliently deformed inwardly and radially. As shown in FIG. 7, in response to deformation, portions of the body 3 are displaced into the cavities 44,49, for example, into the clearances between the bulges 11,11, 28,28. This allows the cavities 44,49 to collapse partially and grip the base portions 8,21.

Forwardly of the shoulder 35, the forward end portion 36 of the body 3 fits within the interior portion 61 of the shell 2 with a sliding fit, rather than a more constrictive, compression fit. Within the forward end portion 36 of the body 3, forward ends of the passages 40,40 are less constricted than are the cavities 44,49. The contact portion 9 of the contact 5 is unconstricted and has freedom to move in the passage 40 toward and away from the contact portion 22 of the second contact 6.

The tray 7 has a base portion 65 supporting the shell 2. The base portion 65 has apertures 66,66 in alignment with corresponding apertures 67,67 in legs 68,68 of the shell 2. Corresponding aligned apertures 66,67 receive a fastener, not shown. An insulative fin 69 separates one pair 4 of contacts from the other pair 4. Passages 70,70, 70,70 through the tray 7 receive corresponding widened sections 15,15, 26,26 of the terminals 10,10, 23,23 with a corresponding compression fit. The channel shapes of the terminals 10,10, 23,23 are partially inwardly deflected and are held in that condition by the corresponding passages 70,70, 70,70.

Figures 5, 5A:
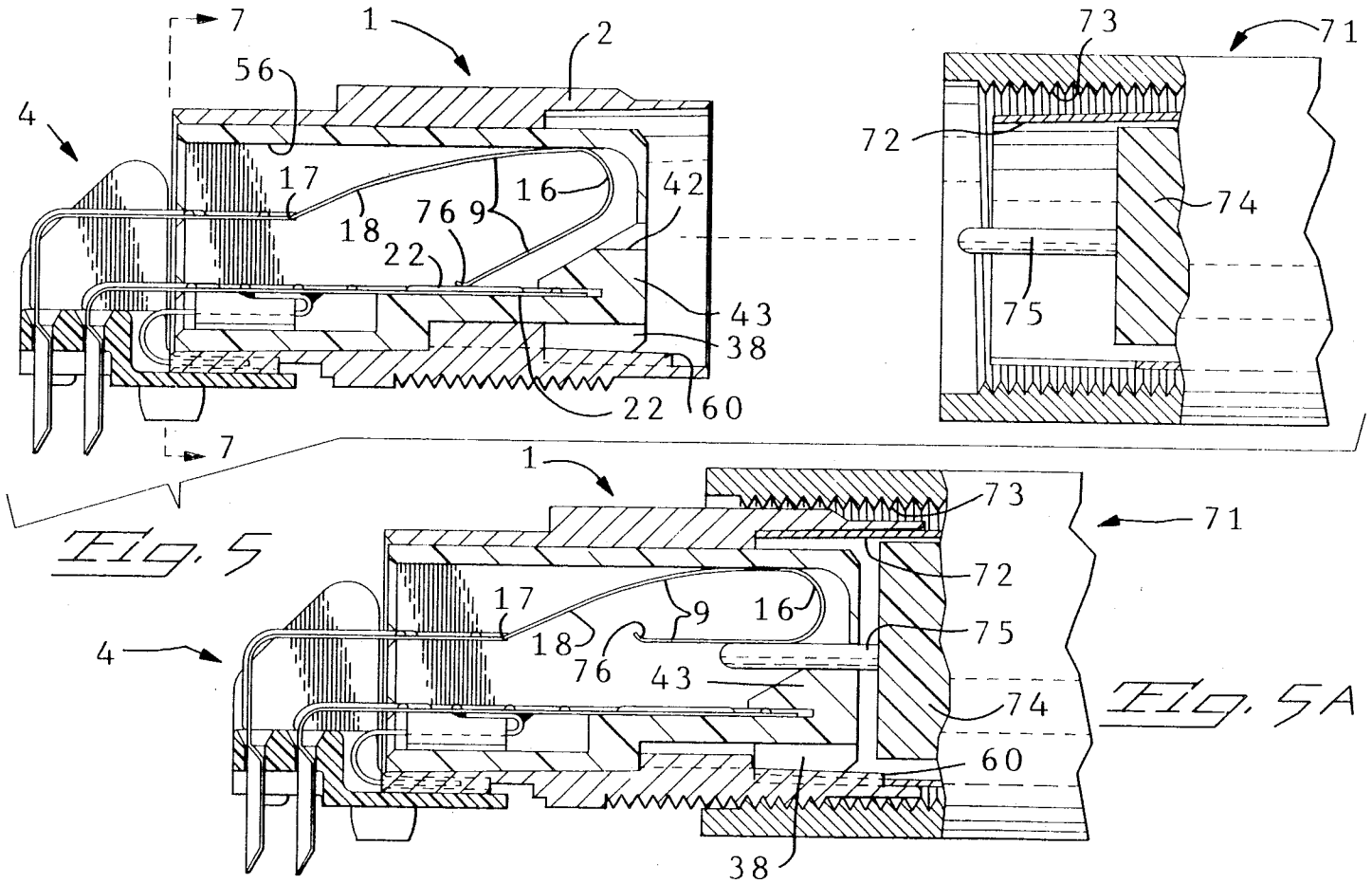
FIG. 5 is a fragmentary elevation view of the connector assembly shown in FIG. 1 assembled, and with a mating connector assembly shown with parts cut away and in section.
FIG. 5A is a fragmentary elevation view similar to FIG. 5, illustrating the connector assemblies shown in FIG. 5 mated together.

As shown in FIG. 5, each ledge 43 extends between a corresponding opening 42 and an end of a corresponding contact portion 22, and between the end of the contact portion 22 and the curved back portion 16 of the contact 5. A complementary connector 71 for mating with the connector assembly 1 has a conductive shell 72 that telescopes within and engages the shell 2 to establish an electrical connection, an internally threaded coupling fastener 73 for threaded connection to the externally threaded shell 2, an insulative body 74 within the shell and a pair of electrically conductive contacts 75,75, one contact 75 is shown, supported in the body 74. Each corresponding contact 75 is a conductive pin that extends through the opening 42 and is supported along and against the ledge 43. The pin 75 deflects the contact portion 9 away from the corresponding contact portion 22 and establishes an electrical connection with the contact portion 9 and not with the contact portion 22. For example, the contact portions 9,22 engage each other and are connected electrically to each other in the absence of the pin 75 of the complementary connector 71. When the connector assembly 1 and complementary connector 71 are mated together, the electrical connection of the contact portions 9,22 is interrupted, and another electrical connection is established between the pin 75 and the contact portion 9. The pin will deflect the contact portion 9, and the contact portion will bow further, to distribute internal stresses along the length from the base to the end 76.

The contact portion 9 extends slightly bowed between the curved back portion 16 and an end 76 of the contact portion 9. As shown in FIGS., 10 and 10A the contact portion 9 may be bent at a location 77 between the curved back portion 16 and the end 76 of the contact portion 9, thereby to extend toward the other contact portion 22 at a first acute angle with respect to the axis of the opening, and at a second angle that is greater than the first angle. The first acute angle is less than the angle of the contact portion 9 that extends between the curved back portion 16 and the end 71 of the contact portion 9. By lessening the angle of the contact portion 9 with respect to the axis of the opening 42, the amount of deflection of the contact portion 9 is lessened. Thereby, the amount of force which resists insertion of the pin 75 into the opening 42 is reduced, and also the amount of internal stress of the contact portion 9 is reduced.

As shown in FIGS. 4, 6 and 7, each cavity 49 intersects a resistor receiving recess 78 that communicates with the end 41 of the body 3 and extends forwardly. A resistor 79 having an electrical lead 81 soldered to the base 8 of the contact 6 is inserted into a corresponding recess 78 during assembly of the contact 6 and the body 3. Another electrical lead 82 of the resistor 79 is assembled with a corresponding recess 83 in the end 58 of the shell 2 and is connected by solder. An empty recess 78 is shown in FIG. 3 because the assembly 1 does not require a resistor 79 to practice the invention.

Modification of the disclosed embodiment of the invention may occur without departing from the spirit and scope of the invention. For example, the complementary mating connector 71 may have any one pin 75 or any number of pins. The invention may be practiced by using a corresponding pair 4 of contacts 5,6 for establishing an electrical connection with each pin 75 of the complementary mating connector 71. Further, the invention may be practiced by using only the single contact 5 and without the second contact 6 for establishing an electrical connection with a corresponding pin 75 of the complementary mating connector 71.

I claim:

1. An electrical connector assembly comprising;

a rigid shell encircling an insulative body, a passage extending along the insulative body, conductive electrical contacts extending along the passage, electrical contact portions and electrical terminals on corresponding electrical contacts, cavities in an end portion of the insulative body extending axially of the body and communicating with the passage, bases of the contacts in the end portion of the insulative body extending axially along corresponding cavities, the end portion of the insulative body is compressed by the encircling shell, the cavities are closed by compression of the end portion of the insulative body against the bases of the contacts to resist withdrawal of the bases from the cavities, at least one of said contact portions is resilient and is in compression against an interior wall of the forward portion of the insulative body, the resilient portion is constructed for movement in the passage toward and away from another of the contact portions, and the resilient portion is constructed for said movement by deflection while in compression against the interior wall, and an opening in the insulative body for receiving an electrical contact of a complementary connector for deflecting the resilient portion away from said another of the contact portions.

2. An electrical connector assembly as recited in claim 1, wherein the resilient contact portion extends outwardly from a corresponding base and is curved back along itself, in a direction toward the corresponding base and into engagement with said another of the contact portions, and said interior wall biases the resilient, curved back contact portion in compression against said another contact portion.

3. An electrical connector assembly as recited in claim 1, wherein an insulative tray supports the shell, apertures through the tray receive corresponding terminals, and an insulative fin on the tray is beside corresponding terminals.

4. An electrical connector assembly as recited in claim 1, further comprising an insulative tray for supporting said shell on a circuit board.

5. An electrical connector assembly as recited in claim 1, further comprising an insulative tray for supporting said shell, said terminals of said contacts extending through said tray.

6. An electrical connector assembly as recited in claim 1, wherein, the contact having said resilient portion has a corresponding base wider than the corresponding terminal and wider than the corresponding contact portion.

7. An electrical connector assembly as recited in claim 1, wherein, said another contact has a corresponding base wider than the corresponding terminal and wider than the corresponding contact portion.

8. An electrical connector assembly as recited in claim 1, wherein, the contacts are assembled with a sliding fit into corresponding cavities, and the corresponding cavities are closed upon insertion of the end portion of the insulative body within the shell.

9. An electrical connector assembly as recited in claim 1, wherein, the bases have edges, and the insulative body is compressed between the edges and the shell to resist movement of the body with respect to the shell.

10. An electrical connector assembly as recited in claim 1, wherein, the resilient contact portion is provided with a first bend adjacent to the base, and a second bend spaced along the contact from the first bend and from the curved back portion.

11. An electrical connector assembly as recited in claim 1, wherein, the resilient contact portion is bent between a curved back portion and an end of the contact portion to lessen an angle of the resilient contact portion with respect to an axis of the opening to reduce the amount of deflection of the resilient contact portion by an electrical contact of the complementary connector.

12. An electrical connector assembly as recited in claim 1, wherein, the bases have thickness planes, and the cavities are closed laterally of corresponding thickness planes of the bases.

13. An electrical connector assembly as recited in claim 1, wherein, projecting barbs extend laterally from corresponding side edges of the bases and the barbs penetrate into the insulative body when the cavities are closed upon corresponding bases.

14. An electrical connector assembly as recited in claim 1, wherein, a recess is in the insulative body, and a resistor in the recess is connected to the shell and to at least one of said contacts.

15. An electrical connector assembly as recited in claim 1, wherein an opening in a second end of the insulative body communicates with the passage, a ledge of the insulative body extends into the passage and extends between the opening and an end of said another of the contact portions, and the opening extends along the ledge.

16. An electrical connector assembly as recited in claim 15, wherein a corresponding contact portion projects toward and engages said another of the contact portions and is aligned with the opening, whereby a conductive contact of a complementary connector extending through the opening is supported against the ledge and deflects the corresponding contact portion away from said another of said contact portions.

17. An electrical connector assembly as recited in claim 15, wherein the ledge is between a doubled back portion of the corresponding contact portion and the end of said another contact portion.

* * * * *